US005935271A

United States Patent [19]

Lappas et al.

[11] Patent Number: 5,935,271

[45] **Date of Patent: *Aug. 10, 1999**

[54] LAUNDRY DETERGENT COMPOSITIONS CONTAINING LIPOLYTIC ENZYME AND AMINES

[75] Inventors: Dimitris Lappas, Strombeek-Bever, Belgium; Rajan Keshav Panandiker, Cincinnati, Ohio; Thomas Wilhelm Horner, Overijse, Belgium; Robert Walter Boswell, Indian Springs, Ohio

[73] Assignee: Procter & Gamble Company, Cincinnati, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/817,154

[22] PCT Filed: Sep. 29, 1995

[86] PCT No.: PCT/US95/12469

§ 371 Date: Aug. 11, 1997

§ 102(e) Date: Aug. 11, 1997

[87] PCT Pub. No.: WO96/12004

PCT Pub. Date: Apr. 25, 1996

[51] Int. Cl.[6] ..... C11D 3/386; D06B 1/00

[52] U.S. Cl. ..... 8/137; 510/284; 510/320; 510/321; 510/332; 510/333; 510/337; 510/392; 510/499; 510/501; 510/530

[58] Field of Search ..... 510/284, 320, 510/321, 332, 333, 337, 499, 501, 392, 530; 8/137

[56] References Cited

U.S. PATENT DOCUMENTS

| | | | |
|---|---|---|---|
| 3,755,085 | 8/1973 | Tivin et al. | 195/68 |
| 4,728,453 | 3/1988 | Choy | 252/91 |
| 4,758,378 | 7/1988 | Raemdonck et al. | 252/544 |
| 4,846,980 | 7/1989 | Upadek et al. | 252/8.8 |
| 4,867,895 | 9/1989 | Choy | 252/91 |
| 5,019,292 | 5/1991 | Baeck et al. | 252/124.25 |
| 5,068,064 | 11/1991 | Proietto et al. | 260/404.5 |
| 5,308,513 | 5/1994 | Harmalker et al. | 252/8.8 |

FOREIGN PATENT DOCUMENTS

| | | | |
|---|---|---|---|
| 0171006 | 2/1986 | European Pat. Off. | C11D 3/30 |
| 0171006 | 12/1986 | European Pat. Off. . | |
| 0588413 | 3/1994 | European Pat. Off. . | |
| 86/07603 | 12/1986 | WIPO . | |
| 92/05249 | 9/1991 | WIPO | C11N 9/20 |
| 92/05249 | 4/1992 | WIPO . | |

*Primary Examiner*—Kery Fries
*Attorney, Agent, or Firm*—C. Brant Cook; Kim W. Zerby; Jacobus C. Rasser

[57] ABSTRACT

The present invention relates to laundry detergent compositions containing a lipolytic enzyme (lipase) and specially selected primary and/or tertiary amines. The compositions provide enhanced cleaning of grease/oil soils and stains, particularly when used in a pre-treat laundering process for cleaning fabrics stained with grease/oil soils.

16 Claims, No Drawings

LAUNDRY DETERGENT COMPOSITIONS CONTAINING LIPOLYTIC ENZYME AND AMINES

FIELD OF THE INVENTION

The present invention relates to laundry detergent compositions containing a lipolytic enzyme (lipase) and specially selected primary and/or tertiary amines. The compositions provide enhanced cleaning of grease/oil soils and stains, particulary when used in a pre-treat laundering process for cleaning fabrics stained with grease/oil soils.

BACKGROUND OF THE INVENTION

The inclusion of lipase in detergent compositions for improved cleaning performance is known, e.g. enhancement of removal of triglycerides containing soils and stains from fabrics. Examples are U.S. Pat. No. 4,769,173; U.S. Pat. No. 5,069,809; PCT application WO94/03578.

In U.S. Pat. No. 4,769,173 is disclosed a certain class of lipases consisting of fungal lipases ex *Humicola lanuginosa* together with strong bleaching agents in detergent compositions. An example of a fungal lipase in this patent is the lipase ex *Humicola lanuginosa*, available from Amano under the tradename Amano-CE. In U.S. Pat. No. 5,069,809 is disclosed the combination of strong bleaching agents with a lipase enzyme produced by cloning the gene encoding the lipase produced by *Humicola lanuginosa* and expressing the gene in *Aspergillus oryzae* as host for use in detergent compositions. In WO 94/03578 is disclosed an enzymatic detergent composition containing 10 to 20 000 LU (Lipolytic units) per gram of detergent composition of a lipase showing a substantial lipolytic activity during the main cycle of a wash process. This lipase is selected in particular on its inactivation behaviour with Diisopropyl Fluoro Phosphate (DFP).

Of the lipase enzymes, only the lipase derived from *Humicola lanuginosa* and produced in *Aspergillus oryzae* as host has so far found wide-spread application as additive for fabric washing products. It is available under the tradename Lipolase®, from Novo Nordisk.

In order to optimize the stain removal performance of Lipolase, Novo Nordisk have made a number of variants. WO 92/05249 describes the D96L variant of the native *Humicola lanuginosa* lipase improves the lard stain removal efficiency by a factor 4.4 over the wild-type lipase (enzymes compared in an amount ranging from 0.075 to 2.5 mg protein per liter).

The ability of lipase to clean soils and stains from fabrics present in the typical load of laundry is of high importance in the evaluation of detergent performance. Unfortunately, the relative ability of lipase to meet various performance criteria is among other depending on the presence of cosurfactants.

There is thus a standing desire for performance and flexibility reasons to make available a surfactant system capable of providing optimum detergency performance of the lipase.

The above objective has been met by a surfactant system comprising a cosurfactant selected from the group of primary or tertiary amines.

It has been surprisingly found that the inclusion of specially selected primary or tertiary amines into liquid detergent compositions containing a lipolytic enzyme (lipase) substantially enhances their ability to rapidly lower the interfacial tension of aqueous washing liquors containing greasy and oily soils. This substantial reduction of interfacial tension of greasy and oily soils improves their removal from soiled surfaces and inhibits the redeposition of the soils onto substrates.

It has also been surprisingly found that liquid detergent compositions containing a lipolytic enzyme and a specially selected primary of tertiary amine show synergistic removal of greasy/oily soils particularly when the detergent composition is used in a pre-treatment application to greasy/oily soil stains on fabrics prior to and in conjunction with a normal wash process of the fabrics.

LIPOLYTIC ENZYME

An essential ingredient in the present laundry detergent compositions is a performance-enhancing amount, preferably from about 0.0001 to 1.0% on an active basis, of a detergent-compatible lipase (lipolytic enzyme). By "detergent-compatible" is meant compatibility with the other ingredients of the composition, particularly detergent surfactants and any detergency builders. Liquid detergent compositions, particularly heavy duty liquids, are preferred herein.

Any lipase suitable for use in a laundry detergent composition can be used herein. Suitable lipases for use herein include those of bacterial and fungal origin. Lipase from chemically or genetically modified mutants are included herein.

Suitable bacterial lipases include those produced by Pseudomonas, such as *Pseudomonas stutzeri* ATCC 19.154, as disclosed in British Patent 1,372,034, incorporated herein by reference. Suitable lipases include those which show a positive immunological cross-reaction with the antibody of the lipase produced by the microorganism *Pseudomonas fluorescens* IAM 1057. This lipase and a method for its purification have been described in Japanese Patent Application 53-20487, laid open on Feb. 24, 1978, which is incorporated herein by reference. This lipase is available under the trade name Lipase P "Amano," hereinafter referred to as "Amano-P." Such lipases should show a positive immunological cross reaction with Amano-P antibody, using the standard and well-known immunodiffusion procedure according to Ouchterlony (Acta. Med. Scan., 133, pages 76–79 (1950)). These lipases, and a method for their immunological cross-reaction with Amano-P, are also described in U.S. Pat. No. 4,707,291, Thom et al., issued Nov. 17, 1987, incorporated herein by reference. Typical examples thereof are the Amano-P lipase, the lipase ex *Pseudomonas fragi* FERM P 1339 (available under the trade name Amano-B), lipase ex *Pseudomonas nitroreducens* var. *lipolyticum* FERM P 1338 (available under the trade name Amano-CES), lipases ex *Chromobacter viscosum,* e.g., *Chromobacter viscosum* var. *lipolyticum* NRRLB 3673, and further *Chromobacter viscosum* lipases, and lipases ex *Pseudomonas gladioli.* Other lipases of interest are Amano AKG and Bacillis Sp lipase.

Suitable fungal lipases include those producible by *Humicola lanuginosa* and *Thermomyces lanuginosus.* Most preferred is lipases obtained by cloning the gene from *Humicola lanuginosa* and expressing the gene in *Aspergillus oryzae* as described in European Patent Application 0 258 068, incorporated herein by reference, commercially available under the trade name Lipolase™.

Highly preferred lipases are the D96L lipolytic enzyme variant of the native lipase derived from *Humicola lanuginosa* as described in U.S. Ser. No. 08/341,826. Preferably the *Humicola lanuginosa* strain DSM 4106 is used. This enzyme is incorporated into the composition in accordance with the invention at a level of from 50 LU to 8500 LU per liter wash solution. Preferably the variant D96L is present at a level of from 100 LU to 7500 LU per liter of wash solution. More preferably at a level of from 150 LU to 5000 LU per liter of wash solution.

By D96L lipolytic enzyme variant is meant the lipase variant as described in patent application WO 92/05249 viz. wherein the native lipase ex *Humicola lanuginosa* aspartic acid (D) residue at position 96 is changed to Leucine (L). According to the nomenclature said substitution of aspartic acid to Leucine in position 96 is shown as: D96L.

It has been found that D96L lipolytic enzyme variant is particularly preferred because of the good odor characteristics associated with the combined use of amines.

From about 2 to about 20,000, preferably about 10 to about 6,000, most preferably from about 200 to about 2000, lipase units per gram (LU/g) of lipase can be used in these compositions. A lipase unit is that amount of lipase which produces 1 $\mu$mol of titratable butyric acid per minute in a pH stat, where pH is 7.0, temperature is 30° C., and substrate is an emulsion of tributyrin, and gum arabic, in the presence of $Ca^{++}$ and NaCl in phosphate buffer.

The Amine

The amines as used herein refer to primary or tertiary amines which is believed to form a mixed micelle with the anionic surfactant and where the carbon chain length of the alkyl group is equal or greater than $C_6$.

Suitable primary amines for use herein include amines according to the formula $R_1NH_2$ wherein $R_1$ is a $C_6$–$C_{12}$, preferably $C_6$–$C_{10}$ alkyl chain or $R_4X(CH_2)_n$, X is —O—, —C(O)NH— or —NH—, $R_4$ is a $C_6$–$C_{12}$ alkyl chain n is between 1 to 5, preferably 3. $R_1$ alkyl chains may be straight or branched and may be interrupted with up to 12, preferably less than 5 ethylene oxide moieties.

Preferred amines according to the formula herein above are n-alkyl amines. Suitable amines for use herein may be selected from 1-hexylamine, 1-octylamine, 1-decylamine and laurylamine. Other preferred primary amines include C8–C10 oxypropylamine, octyloxypropylamine, 2-ethylhexyloxypropylamine, lauryl amido propylamine and amido propylamine.

Suitable tertiary amines for use herein include tertiary amines having the formula $R_1R_2R_3N$ wherein R1 and R2 are $C_1$–$C_8$ alkylchains or

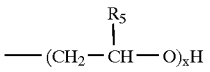

$R_3$ is either a $C_6$–$C_{12}$, preferably $C_6$–$C_{10}$ alkyl chain, or $R_3$ is $R_4X(CH_2)_n$, whereby X is —O—, —C(O)NH— or —NH—, $R_4$ is a $C_4$–$C_{12}$, n is between 1 to 5, preferably 2–3. $R_5$ is H or $C_1$–$C_2$ alkyl and x is between 1 to 6.

$R_3$ and $R_4$ may be linear or branched; $R_3$ alkyl chains may be interrupted with up to 12, preferably less than 5, ethylene oxide moieties.

Preferred tertiary amines are $R_1R_2R_3N$ where R1 is a C6–C12 alkyl chain, R2 and R3 are C1–C3 alkyl or

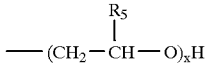

where R5 is H or CH3 and x=1–2. Also preferred are the amidoamines of the formula:

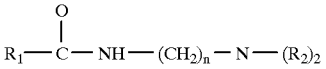

wherein $R_1$ is $C_6$–$C_{12}$ alkyl; n is 2–4, preferably n is 3; $R_2$ and $R_3$ is $C_1$–$C_4$ Most preferred amines of the present invention include 1-octylamine, 1-hexylamine, 1-decylamine, 1-dodecylamine, C8–10oxypropylamine, N coco 1-3diaminopropane, coconutalkyldimethylamine, lauryldimethylamine, lauryl bis(hydroxyethyl) amine, coco bis(hydroxyehtyl)amine, lauryl amine 2 moles propoxylated, octyl amine 2 moles propoxylated, lauryl amidopropyldimethylamine, C8–10 amidopropyldimethylamine and C10 amidopropyldimethylamine. The most preferred amines for use in the compositions herein are 1-hexylamine, 1-octylamine, 1-decylamine, 1-dodecylamine. Especially desirable are n-dodecyldimethylamine and bishydroxyethylcoconutalkylamine and oleylamine 7 times ethoxylated, lauryl amido propylamine and cocoamido propylamine.

FABRIC LAUNDERING AND PRETREATMENT PROCESS

The present invention also provides a process for laundering fabrics soiled with greasy/oily stains or soil. Such a process employs contacting these fabrics with an aqueous washing solution formed from an effective amount of the detergent compositions hereinbefore described. Contacting of fabrics with washing solution will generally occur under conditions of agitation.

Agitation is preferably provided in a washing machine for good cleaning. Washing is preferably followed by drying the wet fabric in a conventional clothes dryer. An effective amount of the liquid or granular detergent composition in the aqueous wash solution in the washing machine is preferably from about 500 to about 7000 ppm, more preferably from about 1000 to 3000 ppm.

The detergent compositions herein may also be used to pretreat fabrics containing greasy/oily soils or stains prior to washing such fabrics using conventional aqueous washing solutions. Such pretreatment involves the application of highly concentrated forms of the detergent compositions herein directly onto the greasy or oily stains or soils found on the fabric to be cleaned. For compositions herein in liquid form, this will generally involve the direct application of the composition as is to the stain/soil on the fabric.

Pretreatment of greasy/oily stains or soils will generally occur for a period of from about 30 seconds to 24 hours prior to washing the pretreated soiled/stained substrate in conventional manner. More preferably, pretreatment times will range from about 1 to 180 minutes.

Detergent Ingredients

In another embodiment of the present invention, the liquid detergent composition may comprise one or more of a surfactant selected from a wide range of surfactants.

A typical listing of anionic, nonionic, ampholytic and zwitterionic classes, and species of these surfactants, is given in U.S. Pat. No. 3,664,961 issued to Norris on May 23, 1972.

Preferred anionic surfactants include the alkyl sulfate surfactants hereof are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{18}$ alkyl component, more preferably a $C_{12}$–$C_{15}$ alkyl or hydroxyalkyl, and M is H or a cation, e.g., an alkali metal cation (e.g. sodium, potassium, lithium), or ammonium or substituted ammonium (e.g. methyl-, dimethyl-, and trimethyl ammonium cations and quaternary ammonium cations such as tetramethyl-ammonium and dimethyl piperdinium cations and quaternary ammonium cations derived from alkylamines such as ethylamine, diethylamine, triethylamine, and mixtures thereof, and the like).

Highly preferred anionic surfactants include alkyl alkoxylated sulfate surfactants hereof are water soluble salts or acids of the formula $RO(A)_mSO3M$ wherein R is an unsubstituted $C_{10}$–$C_{24}$ alkyl or hydroxyalkyl group having a $C_{10}$–$C_{24}$ alkyl component, preferably a $C_{12}$–$C_{18}$ alkyl or hydroxyalkyl, more preferably $C_{12}$–$C_{15}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl, trimethylammonium cations and quaternary ammonium cations such as tetramethyl-ammonium and dimethyl piperdinium cations and those derived from alkylamines such as ethylamine, diethylamine, triethylamine, mixtures thereof, and the like. Exemplary surfactants are $C_{12}$–$C_{15}$ alkyl polyethoxylate (1.0) sulfate ($C_{12}$–$C_{15}E(1.0)M$), $C_{12}$–$C_{15}$ alkyl polyethoxylate (2.25) sulfate ($C_{12}$–$C_{15}E(2.25)M$), $C_{12}$–$C_{15}$ alkyl polyethoxylate (3.0) sulfate ($C_{12}$–$C_{15}E(3.0)M$), and $C_{12}$–$C_{15}$ alkyl polyethoxylate (4.0) sulfate ($C_{12}$–$C_{15}E(4.0)M$), wherein M is conveniently selected from sodium and potassium.

Other suitable anionic surfactants to be used are alkyl ester sulfonate surfactants including linear esters of $C_8$–$C_{20}$ carboxylic acids (i.e., fatty acids) which are sulfonated with gaseous $SO_3$ according to "The Journal of the American Oil Chemists Society", 52 (1975), pp. 323–329. Suitable starting materials would include natural fatty substances as derived from tallow, palm oil, etc.

The preferred alkyl ester sulfonate surfactant, especially for laundry applications, comprise alkyl ester sulfonate surfactants of the structural formula:

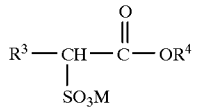

wherein $R^3$ is a $C_8$–$C_{20}$ hydrocarbyl, preferably an alkyl, or combination thereof, $R^4$ is a C–$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations, such as monoethanolamine, diethanolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{10}$–$C_{16}$ alkyl.

Other anionic surfactants useful for detersive purposes can also be included in the laundry detergent compositions of the present invention. These can include salts (including, for example, sodium, potassium, ammonium, and substituted ammonium salts such as mono-, di- and triethanolamine salts) of soap, $C_9$–$C_{20}$ linear alkylbenzenesulfonates, $C_8$–$C_{22}$ primary of secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl glycerol sulfonates, fatty acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinates (especially saturated and unsaturated $C_{12}$–$C_{18}$ monoesters) and diesters of sulfosuccinates (especially saturated and unsaturated $C_6$–$C_{12}$ diesters), sulfates of alkylpolysaccharides such as the sulfates of alkylpolyglucoside (the nonionic nonsulfated compounds being described below), and alkyl polyethoxy carboxylates such as those of the formula $RO(CH_2CH_2O)_k$—$CH_2COO$-M+ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are described in "Surface-Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

When included therein, the laundry detergent compositions of the present invention typically comprise from about 1% to about 40%, preferably from about 5% to about 25% by weight of such anionic surfactants.

One class of nonionic surfactants useful in the present invention are condensates of ethylene oxide with a hydrophobic moiety to provide a surfactant having an average hydrophilic-lipophilic balance (HLB) in the range from 8 to 17, preferably from 9.5 to 14, more preferably from 12 to 14. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Especially preferred nonionic surfactants of this type are the $C_9$–$C_{15}$ primary alcohol ethoxylates containing 3–12 moles of ethylene oxide per mole of alcohol, particularly the $C_{12}$–$C_{15}$ primary alcohols containing 5–8 moles of ethylene oxide per mole of alcohol.

Another class of nonionic surfactants comprises alkyl polyglucoside compounds of general formula $$RO\ (C_nH_{2n}O)_tZ_x$$

wherein Z is a moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chain alkyl polyglucosides.

Compounds of this type and their use in detergent are disclosed in EP-B 0 070 077, 0 075 996 and 0 094 118.

Also suitable as nonionic surfactants are poly hydroxy fatty acid amide surfactants of the formula

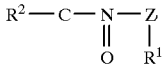

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or alkenyl chain such as coconut alkyl or mixtures thereof, and Z is derived from a reducing sugar such as glucose, fructose, maltose, lactose, in a reductive amination reaction.

Highly preferred nonionics are amine oxide surfactants. The compositions of the present invention may comprise amine oxide in accordance with the general formula I:

$$R^1(EO)_x(PO)_y(BO)_zN(O)(CH_2R')_2.qH_2O \quad (I)$$

In general, it can be seen that the structure (I) provides one long-chain moiety $R^1(EO)_x(PO)_y(BO)_z$ and two short chain moieties, $CH_2R'$. R' is preferably selected from hydrogen, methyl and —$CH_2OH$. In general $R^1$ is a primary or branched hydrocarbyl moiety which can be saturated or unsaturated, preferably, $R^1$ is a primary alkyl moiety. When x+y+z=0, $R^1$ is a hydrocarbyl moiety having chainlength of from about 8 to about 18. When x+y+z is different from 0, $R^1$ may be somewhat longer, having a chainlength in the range $C_{12}$–$C_{24}$. The general formula also encompasses amine oxides wherein x+y+z=0, $R_1=C_8$–$C_{18}$, R'=H and q=0–2, preferably 2. These amine oxides are illustrated by C12–14 alkyldimethyl amine oxide, hexadecyl dimethylamine oxide, octadecylamine oxide and their hydrates, especially the dihydrates as disclosed in U.S. Pat. Nos. 5,075,501 and 5,071,594, incorporated herein by reference.

The invention also encompasses amine oxides wherein x+y+z is different from zero, specifically x+y+z is from about 1 to about 10, $R^1$ is a primary alkyl group containing 8 to about 24 carbons, preferably from about 12 to about 16 carbon atoms; in these embodiments y+z is preferably 0 and x is preferably from about 1 to about 6, more preferably from about 2 to about 4; EO represents ethyleneoxy; PO represents propyleneoxy; and BO represents butyleneoxy. Such amine oxides can be prepared by conventional synthetic methods, e.g., by the reaction of alkylethoxysulfates with dimethylamine followed by oxidation of the ethoxylated amine with hydrogen peroxide.

Highly preferred amine oxides herein are solids at ambient temperature, more preferably they have melting-points in the range 30° C. to 90° C. Amine oxides suitable for use herein are made commercially by a number of suppliers, including Akzo Chemie, Ethyl Corp., and Procter & Gamble. See McCutcheon's compilation and Kirk-Othmer review article for alternate amine oxide manufacturers. Preferred commercially available amine oxides are the solid, dihydrate ADMOX 16 and ADMOX 18, ADMOX 12 and especially ADMOX 14 from Ethyl Corp. Preferred embodiments include hexadecyldimethylamine oxide dihydrate, dodecyldimethylamine oxide dihydrate, octadecyldimethylamine oxide dihydrate, hexadecyltris (ethyleneoxy) dimethyl-amine oxide, and tetradecyldimethyl-amine oxide dihydrate.

Whereas in certain of the preferred embodiments R'=H, there is some latitude with respect to having R' slightly larger than H. Specifically, the invention further encompasses embodiments wherein R'=$CH_2OH$, such as hexadecylbis(2-hydroxyethyl)amine oxide, tallowbis(2-hydroxyethyl)amine oxide, stearylbis(2-hydroxyethyl) amine oxide and oleylbis(2-hydroxyethyl)amine oxide, dodecyldimethylamine oxide dihydrate.

When included therein, the laundry detergent compositions of the present invention typically comprise nonionic surfactants in the weight ratio of anionic surfactant to nonionic surfactant from 6:1 to 1:3, preferably from 5:1 to 2:1.

Cationic detersive surfactants suitable for use in the laundry detergent compositions of the present invention are those having one long-chain hydrocarbyl group. Examples of such cationic surfactants include the ammonium surfactants such as alkyldimethylammonium halogenides, and those surfactants having the formula:

$$[R^2(OR^3)_y][R^4(OR^3)_y]_2R^5N+X-$$

wherein $R^2$ is an alkyl or alkyl benzyl group having from about 8 to about 18 carbon atoms in the alkyl chain, each $R^3$ is selected from the group consisting of —$CH_2CH_2$—, —$CH_2CH(CH_3)$—, —$CH_2CH(CH_2OH)$—, —$CH_2CH_2CH_2$—, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, —$CH_2CHOHCHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Preferred cationic surfactants are the water-soluble quaternary ammonium compounds useful in the present composition having the formula:

$$R_1R_2R_3R_4N^+X^- \quad (i)$$

wherein $R_1$ is $C_8$–$C_{16}$ alkyl, each of $R_2$, $R_3$ and $R_4$ is independently $C_1$–$C_4$ alkyl, $C_1$–$C_4$ hydroxy alkyl, benzyl, and —$(C_2H_4O)_xH$ where x has a value from 1 to 5, and X is an anion. Not more than one of $R_2$, $R_3$ or $R_4$ should be benzyl.

The preferred alkyl chain length for $R_1$ is $C_{12}$–$C_{15}$ particularly where the alkyl group is a mixture of chain lengths derived from coconut or palm kernel fat or is derived synthetically by olefin build up or OXO alcohols synthesis. Preferred groups for $R_2R_3$ and $R_4$ are methyl and hydroxyethyl groups and the anion X may be selected from halide, methosulphate, acetate and phosphate ions.

Examples of suitable quaternary ammonium compounds of formulae (i) for use herein are:

- coconut trimethyl ammonium chloride or bromide;
- coconut methyl dihydroxyethyl ammonium chloride or bromide;
- decyl triethyl ammonium chloride;
- decyl dimethyl hydroxyethyl ammonium chloride or bromide;
- $C_{12-15}$ dimethyl hydroxyethyl ammonium chloride or bromide;
- coconut dimethyl hydroxyethyl ammonium chloride or bromide;

myristyl trimethyl ammonium methyl sulphate;

lauryl dimethyl benzyl ammonium chloride or bromide;

lauryl dimethyl (ethenoxy)$_4$ ammonium chloride or bromide;

choline esters (compounds of formula (i) wherein $R_1$ is —$CH_2$—O—C(O)—$C_{12-14}$ alkyl and $R_2R_3R_4$ are methyl).

Other cationic surfactants useful herein are also described in U.S. Pat. No. 4,228,044, Cambre, issued Oct. 14, 1980.

When included therein, the laundry detergent compositions of the present invention typically comprise from 0.5% to about 5%, preferably from about 1% to about 3% by weight of such cationic surfactants.

The compositions according to the present invention may further comprise a builder system. Any conventional builder system is suitable for use herein including aluminosilicate materials, silicates, polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylenephosphonic acid. Though less preferred for obvious environmental reasons, phosphate builders can also be used herein.

Suitable polycarboxylates builders for use herein include citric acid, preferably in the form of a water-soluble salt, derivatives of succinic acid of the formula R—CH(COOH) CH2(COOH) wherein R is C10–20 alkyl or alkenyl, preferably C12–16, or wherein R can be substituted with hydroxyl, sulfo sulfoxyl or sulfone substituents. Specific examples include lauryl succinate, myristyl succinate, palmityl succinate 2-dodecenylsuccinate, 2-tetradecenyl succinate. Succinate builders are preferably used in the form of their water-soluble salts, including sodium, potassium, ammonium and alkanolammonium salts.

Other suitable polycarboxylates are oxodisuccinates and mixtures of tartrate monosuccinic and tartrate disuccinic acid such as described in U.S. Pat. No. 4,663,071.

Especially for the liquid execution herein, suitable fatty acid builders for use herein are saturated or unsaturated C10–18 fatty acids, as well as the corresponding soaps. Preferred saturated species have from 12 to 16 carbon atoms in the alkyl chain. The preferred unsaturated fatty acid is oleic acid. Other preferred builder system for liquid compositions is based on dodecenyl succinic acid and citric acid.

Detergency builder salts are normally included in amounts of from 3% to 50% by weight of the composition preferably from 5% to 30% and most usually from 5% to 25% by weight.

Optional Detergent Ingredients:

Preferred detergent compositions of the present invention may further comprise one or more enzymes which provide cleaning performance and/or fabric care benefits. Said enzymes include enzymes selected from cellulases, hemicellulases, peroxidases, proteases, gluco-amylases, amylases, lipases, cutinases, pectinases, xylanases, reductases, oxidases, phenoloxidases, lipoxygenases, ligninases, pullulanases, tannases, pentosanases, malanases, β-glucanases, arabinosidases or mixtures thereof.

A preferred combination is a detergent composition having a cocktail of conventional applicable enzymes like protease, amylase, lipase, cutinase and/or cellulase in conjunction with the lipolytic enzyme variant D96L at a level of from 50 LU to 8500 LU per liter wash solution.

The cellulases usable in the present invention include both bacterial or fungal cellulase. Preferably, they will have a pH optimum of between 5 and 9.5. Suitable cellulases are disclosed in U.S. Pat. No. 4,435,307, Barbesgoard et al, which discloses fungal cellulase produced from Humicola insolens. Suitable cellulases are also disclosed in GB-A-2.075.028; GB-A-2.095.275 and DE-OS-2.247.832.

Examples of such cellulases are cellulases produced by a strain of Humicola insolens (*Humicola grisea* var. *thermoidea*), particularly the Humicola strain DSM 1800. Other suitable cellulases are cellulases originated from Humicola insolens having a molecular weight of about 50 KDa, an isoelectric point of 5.5 and containing 415 amino acids. Especially suitable cellulases are the cellulases having color care benefits. Examples of such cellulases are cellulases described in European patent application No. 91202879.2, filed Nov. 6, 1991 (Novo).

Peroxidase enzymes are used in combination with oxygen sources, e.g. percarbonate, perborate, persulfate, hydrogen peroxide, etc. They are used for "solution bleaching", i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813 and in European Patent application EP No. 91202882.6, filed on Nov. 6, 1991.

Said cellulases and/or peroxidases are normally incorporated in the detergent composition at levels from 0.0001% to 2% of active enzyme by weight of the detergent composition.

Preferred commercially available protease enzymes include those sold under the tradenames Alcalase, Savinase, Primase, Durazym, and Esperase by Novo Nordisk A/S (Denmark), those sold under the tradename Maxatase, Maxacal and Maxapem by Gist-Brocades, those sold by Genencor International, and those sold under the tradename Opticlean and Optimase by Solvay Enzymes. Also proteases described in our co-pending application U.S. Ser. No. 08/136,797 can be included in the detergent composition of the invention. Protease enzyme may be incorporated into the compositions in accordance with the invention at a level of from 0.0001% to 2% active enzyme by weight of the composition.

A preferred protease herein referred to as "Protease D" is a carbonyl hydrolase variant having an amino acid sequence not found in nature, which is derived from a precursor carbonyl hydrolase by substituting a different amino acid for the amino acid residue at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens* subtilisin, as described in the concurrently filed patent application of A. Baeck et al. entitled "Protease-Containing Cleaning Compositions" having U.S. Ser. No. 08/322,676, filed Oct. 13, 1994, which is incorporated herein by reference in its entirety.

Also suitable are cutinases [EC 3.1.1.50] which can be considered as a special kind of lipase, namely lipases which do not require interfacial activation. Addition of cutinases to detergent compositions have been described in e.g. WO-A-88/09367 (Genencor).

The lipases and/or cutinases are normally incorporated in the detergent composition at levels from 0.0001% to 2% of active enzyme by weight of the detergent composition.

Amylases (& and/or β) can be included for removal of carbohydrate-based stains. Suitable amylases are Termamyl® (Novo Nordisk), Fungamyl® and BAN® (Novo Nordisk).

The above-mentioned enzymes may be of any suitable origin, such as vegetable, animal, bacterial, fungal and yeast origin.

Said enzymes are normally incorporated in the detergent composition at levels from 0.0001% to 2% of active enzyme by weight of the detergent composition.

Other suitable detergent ingredients that can be added are enzyme oxidation scavengers which are described in Copending European Patent application 92870018.6 filed on Jan. 31, 1992. Examples of such enzyme oxidation scavengers are ethoxylated tetraethylene polyamines.

A preferred component to be used in the detergent compositions of the present invention comprise soil-release agents.

Soil release agents useful in compositions of the present invention are conventionally copolymers or terpolymers of terephthalic acid with ethylene glycol and/or propylene glycol units in various arrangements. Examples of such polymers are disclosed in the commonly assigned U.S. Pat. Nos. 4,116,885 and 4,711,730 and European Published Patent Application No. 0 272 033. A particular preferred polymer in accordance with EP-A-0 272 033 has the formula $$(CH_3(PEG)_{43})_{0.75}(POH)_{0.25}[T\text{-}PO)_{2.8}(T\text{-}PEG)_{0.4}]$$
$$T(POH_{0.25}((PEG)_{43}CH_3)_{0.75}$$

where PEG is —$(OC_2H_4)O$—, PO is $(OC_3H_6O)$ and T is $(pcOC_6H_4CO)$.

Also very useful are modified polyesters as random copolymers of dimethyl terephtalate, dimethyl sulfoisophtalate, ethylene glycol and 1–2 propane diol, the end groups consisting primarily of sulphobenzoate and secondarily of mono esters of ethylene glycol and/or propane-diol. The target is to obtain a polymer capped at both end by sulphobenzoate groups, "primarily", in the present context most of said copolymers herein will be end-capped by sulphobenzoate groups. However, some copolymers will be less than fully capped, and therefore their end groups may consist of monoester of ethylene glycol and/or propane 1–2 diol, thereof consist "secondarily" of such species.

The selected polyesters herein contain about 46% by weight of dimethyl terephtalic acid, about 16% by weight of propane –1.2 diol, about 10% by weight ethylene glycol about 13% by weight of dimethyl sulfobenzoid acid and about 15% by weight of sulfoisophtalic acid, and have a molecular weight of about 3.000. The polyesters and their method of preparation are described in detail in EPA 311 342.

Particularly suitable soil-release polymers include oligomeric esters such as described in U.S. patent application Ser. No. 08/355 938 filed Dec. 14, 1994. Said esters comprise (1) a backbone comprising (a) at least one unit selected from the group consisting of dihydroxy or polyhydroxy sulfonate, a unit which is at least trifunctional whereby ester linkages are formed resulting in a branched oligomer backbone, and combinations thereof;

(b) at least one unit which is a terephthaloyl moiety; and (c) at least one unsulfonated unit which is a 1,2-oxyalkleneoxy moiety;

(2) one or more (nonionic and/or anionci) capping units.

Preferred ester molecules have the following structure (Formula A):

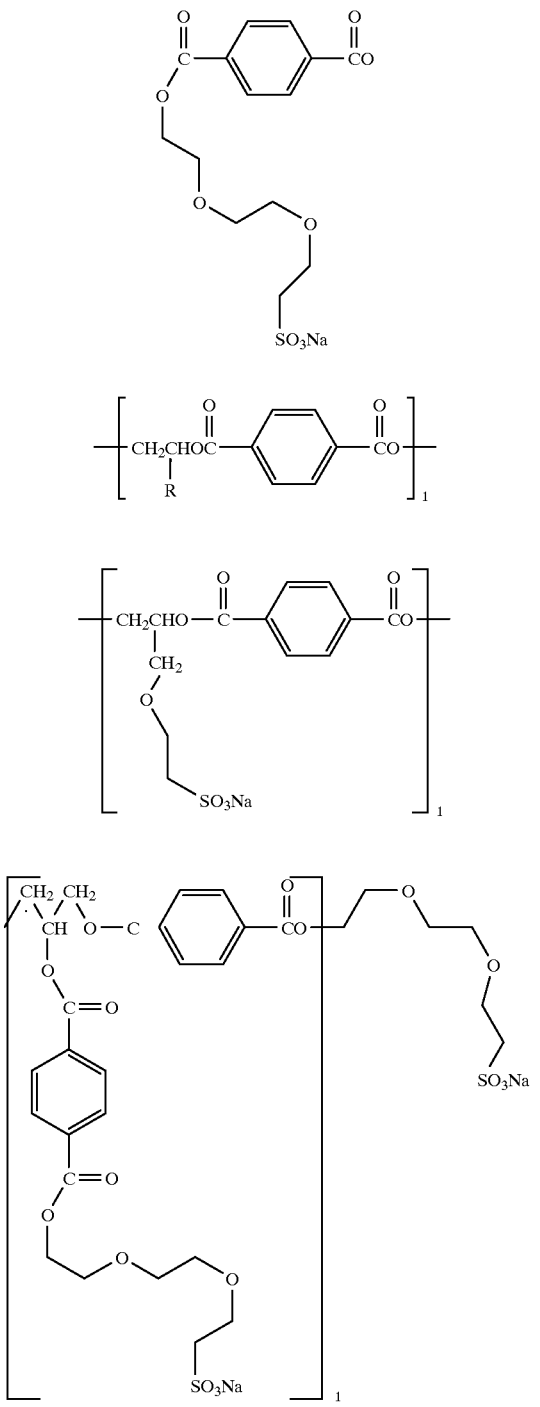

where R=H, $CH_3$ in 1.7:1 ratio, which is an example of an oligomer having three SE3 capping units, one SEG unit, and one glycerin unit incorporated into the oligomer structure.

Other components used in detergent compositions may be employed, such as soil-suspending agents, abrasives, bactericides, tarnish inhibitors, coloring agents, foam control agents, corrosion inhibitors and perfumes.

Preferably, the liquid compositions according to the present invention are in "concentrated form"; in such case, the liquid detergent compositions according to the present invention will contain a lower amount of water, compared to conventional liquid detergents. The level of water is less than 50%, preferably less than 30% by weight of the detergent compositons.

Said concentrated products provide advantages to the consumer, who has a product which can be used in lower amounts and to the producer, who has lower shipping costs.

The liquid compositions are especially effective when applied directly to soils and stains in a pretreatment step.

The detergent compositions of the present invention can also be used as detergent additive products. Such additive products are intended to supplement or boost the performance of conventional detergent compositions.

The detergent compositions according to the present invention include compositions which are to be used for cleaning of substrates, such as fabrics, fibers, hard surfaces, skin etc., for example hard surface cleaning compositions (with or without abrasives), laundry detergent compositions, automatic and non-automatic dishwashing compositions.

The following examples are meant to exemplify compositions of the present inventions, but are not necessarily meant to limit the scope of the invention.

EXAMPLES

Example 1

The following liquid detergent compositions are made:

| | % by weight of the detergent compositions | | | | |
|---|---|---|---|---|---|
| | A | B | C | D | E |
| Lineair alkylbenzene sulfonate | 18 | — | — | — | — |
| $C_{12}$–$C_{15}$ Alkyl ethoxylated sulfate | — | 2 | 8 | 11 | 5 |
| $C_8$–$C_{10}$ amidopropyl amine | 2 | 2 | 2 | 2 | 1 |
| $C_{12}$–$C_{14}$ alkyldimethyl amine oxide | — | — | — | — | 2 |
| $C_{12}$–$C_{15}$ Alkyl sulfate | — | 17 | 12 | 7 | 8 |
| $C_{12}$–$C_{14}$ N-methyl glucamide | — | 5 | 4 | 4 | 3 |
| $C_{12}$–$C_{14}$ fatty alcohol ethoxylate | 12 | 6 | 1 | 1 | 1 |
| $C_{12}$–$C_{18}$ Fatty acid | 11 | 11 | 4 | 4 | 3 |
| Citric acid anhydrous | 5 | 1 | 3 | 3 | 2 |
| Diethylene triamine penta methylene phosphonic acid | 1 | 1 | 1 | 1 | 0.5 |
| Monoethanolamine | 11 | 8 | 5 | 5 | 2 |
| Sodium hydroxide | 1 | 1 | 2.5 | 1 | 1.5 |
| Propanediol | 12.7 | 14.5 | 13.1 | 10.0 | 8 |
| Ethanol | 1.8 | 1.8 | 4.7 | 5.4 | 1 |
| Amylase (300 KNU/g) | 0.1 | 0.1 | 0.1 | 0.1 | 0.1 |
| Lipase D96/L(100 KNU/g) | 0.15 | 0.15 | 0.15 | 0.15 | 0.15 |
| Protease (34 g/l) | 0.5 | 0.5 | 0.5 | 0.5 | 0.5 |
| Endo-A (5000 CEVU/g) | 0.05 | 0.05 | 0.05 | 0.05 | 0.05 |
| Carezyme (5000 CEVU/g) | 0.09 | 0.09 | 0.09 | 0.09 | 0.9 |
| Terephthalate-based polymer | 0.15 | 0.15 | — | — | — |
| Oligomeric ester (Formula A) | — | — | 0.07 | 0.07 | 0.07 |
| Boric acid | 2.4 | 2.4 | 2.8 | 2.8 | 2.4 |
| Sodium xylene sulfonate | — | — | 3 | — | — |
| DC 3225C | 0.03 | 0.04 | 0.04 | 0.03 | 0.03 |
| 2-butyl-octanol | 1 | 1 | 1 | 1 | 1 |
| Branched silicone | 0.3 | 0.3 | 0.3 | 0.3 | 0.3 |
| Water & Minors | up to 100% | | | | |

Example 2

| Ingredient | A Wt % | B Wt % | C Wt % |
|---|---|---|---|
| C12–15 alkyl polyethoxylate (2.5) sulfate | 13.50 | 13.70 | 9.40 |
| C12–15 alkyl sulfate | 4.50 | 4.00 | 3.10 |

-continued

| Ingredient | A Wt % | B Wt % | C Wt % |
|---|---|---|---|
| Ethanol | 3.50 | 2.64 | 2.18 |
| Monoethanolamine | 1.00 | 0.75 | 1.00 |
| C10 amidopropyldimethyl amine | 1.30 | 1.30 | 1.30 |
| Propandiol | 7.50 | 7.50 | 3.20 |
| C12–13 Alkyl polyethoxylate (9) | 2.00 | 0.63 | 1.00 |
| C12–14 alkyl glucose amide | 4.50 | 3.35 | 2.00 |
| C12–14 fatty acid | 2.00 | 3.50 | 1.00 |
| Lipolase | 0.18 | 0.18 | 0.18 |
| Sodium toluene sulfonate | 2.50 | 2.25 | 2.25 |
| Citric acid | 3.00 | 2.65 | 1.80 |
| Borax | 3.50 | 3.50 | — |
| Sodium hydroxide (to pH 8.0) | 2.95 to pH = 8.0 | 2.10 to pH = 7.6 | 2.07 to pH = 8.0 |
| Tetraethylenepentamine ethoxylated (15–18) | 1.18 | 1.18 | 1.00 |
| Water, perfume, enzymes, soil release polymers suds suppressor & other optional ingredients | to 100% | to 100% | to 100% |

Example 3

| Ingredient | A Wt % | B Wt % | C Wt % | D Wt % |
|---|---|---|---|---|
| C12–15 alkyl polyethoxylate (3) sulfate | 13.70 | 13.70 | 13.70 | 13.70 |
| C12–15 alkyl sulfate | 4.00 | 4.00 | 4.00 | 4.00 |
| Ethanol | 2.64 | 2.64 | 2.64 | 2.64 |
| Monoethanolamine | 0.75 | 0.75 | 0.75 | 0.75 |
| C12 amidopropyl-dimethyl amine | 1.30 | — | — | — |
| C10 amidopropyl-dimethyl amine | — | 1.3 | — | — |
| C12 bis (hydroxyethyl) amine | — | — | 1.3 | 1.3 |
| Octylamine | — | — | — | — |
| Propandiol | 7.50 | 7.50 | 7.50 | 7.50 |
| C12–13 Alkyl polyethoxylate (9) | 0.63 | 0.63 | 0.63 | 0.63 |
| C12–14 alkyl glucose amide | 3.35 | 3.35 | 3.35 | 3.35 |
| C12–16 fatty acid | 3.50 | 3.50 | 3.50 | 3.50 |
| Lipolase | 0.12 | 0.12 | 0.12 | 0.12 |
| Sodium toluene sulfonate | 2.25 | 2.25 | 2.25 | 2.25 |
| Citric acid | 2.65 | 2.65 | 2.65 | 2.65 |
| Borax | 3.50 | 3.50 | 3.50 | 3.50 |
| Sodium hydroxide | 2.1 to pH = 7.6 | 2.1 to pH = 7.6 | 2.1 to pH = 7.6 | 2.1 to pH = 7.6 |
| Tetraethylenepentamine ethoxylated (15–18) | 1.18 | 1.18 | 1.18 | 1.18 |
| Water, perfume, enzymes, soil release polymers suds suppressor & other optional ingredients | to 100% | to 100% | to 100% | to 100% |

The above liquid detergent compositions of Examples 1, 2 and 3 were found to be very efficient in the removal of greasy/oily soils under various usage conditions, particularly when used in a pretreatment process.

What is claimed is:

1. A liquid laundry detergent composition comprising the following:

(A) a lipase enzyme at a level of 2 to 20,000 LU/g;

(B) 1% to 40% of a surfactant; and (C) a tertiary amine having the formula $R_1R_2R_3N$ wherein $R_1$ and $R_2$ are $C_1$–$C_8$ alkyl chains or

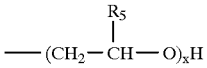

wherein $R_5$ is H or $C_1$ or $C_2$ alkyl and x is an integer between 1 and 6; $R_3$ is $R_4X(CH_2)_n$ wherein X is —NH—, $R_4$ is a $C_4$–$C_{12}$ alkyl chain, and n is 2 or 3.

2. The liquid detergent composition according to claim 1 wherein said lipolytic enzyme is a lipase enzyme which is a mutant lipase enzyme comprising the D96L mutation.

3. The liquid detergent composition according to claim 2 wherein said mutant lipase enzyme is a mutated enzyme D96L derived from *Humicola lanuginosa*.

4. The liquid detergent composition according to claim 3 wherein said mutated enzyme D96L is present in said composition at a level such that the mutated enzyme D96L is present in a wash solution including said composition at a level from 50 LU to 8500 LU per liter of said wash solution.

5. The liquid detergent composition according to claim 4 wherein said mutated enzyme D96L is present in said composition at a level such that the mutated enzyme D96L is present in a wash solution including said composition at a level from 100 LU to 7500 LU per liter of said wash solution.

6. The liquid detergent composition according to claim 5 wherein said mutated enzyme D96L is present in said composition at a level such that the mutated enzyme D96L is present in a wash solution including said composition at a level from 150 LU to 5000 LU per liter of said wash solution.

7. The liquid detergent composition according to claim 1 wherein said mutated enzyme D96L is present in said composition at a level from about 10 to about 6,000 LU/g of said composition.

8. The liquid detergent composition according to claim 7 wherein said mutated enzyme D96L is present in said composition at a level from about 200 to about 2,000 LU/g of said composition.

9. The liquid detergent composition according to claim 1 wherein said composition further comprises water.

10. The liquid detergent composition according to claim 9 wherein said composition comprises less than 50% by weight of water.

11. The liquid detergent composition according to claim 10 wherein said composition comprises less than 30% by weight of water.

12. The liquid detergent composition according to claim 1 wherein said composition further comprises an ingredient selected from the group consisting of builders, enzymes, and mixtures thereof.

13. A method for laundering greasy/oily stained fabrics in need of laundering comprising contacting said fabrics with an aqueous solution comprising a liquid laundry detergent composition comprising:

(A) a lipase enzyme at a level of 2 to 20,000 LU/g of said composition;

(B) 1% to 40% of a surfactant; and (C) a tertiary amine having the formula $R_1R_2R_3N$ wherein $R_1$ and $R_2$ are $C_1$–$C_8$ alkyl or

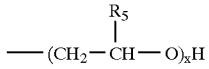

wherein $R_5$ is H or $C_1$ and $C_2$ alkyl and x is an integer between 1 and 6; $R_3$ is $R_4X(CH_2)_n$ wherein X is —NH—, $R_4$ is a $C_4$–$C_{12}$ alkyl chain, and n is 2 or 3.

14. A method for pretreating fabrics having greasy/oily stains comprising contacting said greasy/oily stains with a liquid detergent composition comprising:

(A) a lipase enzyme at a level of 2 to 20,000 LU/g of said composition;

(B) 1% to 40% of a surfactant; and (C) a tertiary amine having the formula $R_1$ $R_2$ $R_3N$ wherein $R_1$ and $R_2$ are $C_1$–$C_8$ alkyl chain or

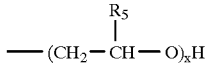

wherein $R_5$ is H or $C_1$ or $C_2$ alkyl and x is an integer between 1 and 6; $R_3$ is $R_4X(CH_2)_n$ wherein X is —NH—, $R_4$ is a $C_4$–$C_{12}$ alkyl chain and n is 2 or 3.

15. The method according to claim 14 wherein said greasy/oily stains are contacted by said liquid detergent composition for from about 30 seconds to about 24 hours.

16. The method according to claim 15 wherein said greasy/oily stains are contacted by said liquid detergent composition for from about 1 to about 180 minutes.

* * * * *

UNITED STATES PATENT AND TRADEMARK OFFICE

CERTIFICATE OF CORRECTION

PATENT NO. : 5,935,271

DATED : August 10, 1999

INVENTOR(S) : Dimitris Lappas

It is certified that error appears in the above-identified patent and that said Letters Patent is hereby corrected as shown below:

On the title page: Item

[30] Foreign Application Priority Data

October 13, 1994 [US] PCT/US94/11779

June 20, 1995 [US] PCT/US95/07824

Signed and Sealed this

Twenty-third Day of May, 2000

*Attest:*

Q. TODD DICKINSON

*Attesting Officer*

*Director of Patents and Trademarks*